United States Patent [19]

McVeigh

[11] 4,378,085

[45] Mar. 29, 1983

[54] STAPLER APPARATUS HAVING A MECHANISM FOR BENDING AND CUTTING STAPLE LEGS IN ACCORDANCE WITH THE THICKNESS OF THE WORK PIECE

[75] Inventor: James H. McVeigh, Rochester, N.Y.

[73] Assignee: Xerox Corporation, Stamford, Conn.

[21] Appl. No.: 203,737

[22] Filed: Nov. 3, 1980

[51] Int. Cl.[3] ..... B25C 5/02

[52] U.S. Cl. ..... 227/79; 227/155

[58] Field of Search ..... 227/77, 79, 108, 155

[56] References Cited

U.S. PATENT DOCUMENTS

| | | | |
|---|---|---|---|
| 1,296,960 | 3/1919 | Hutchison . | |
| 1,807,170 | 5/1931 | Peterson | 227/155 X |
| 1,996,222 | 4/1935 | Vogel | 227/155 |
| 2,281,896 | 5/1942 | Weimont | 227/79 X |
| 2,357,737 | 9/1944 | Harred | 1/49 |
| 3,034,382 | 5/1962 | Hazel | 227/79 X |
| 4,165,557 | 8/1979 | Taguchi et al. | 227/79 X |
| 4,194,666 | 3/1980 | Spehrley, Jr. et al. | 227/155 |
| 4,199,095 | 4/1980 | Yamanoi | 227/155 X |
| 4,315,589 | 2/1982 | Soong | 227/155 X |

*Primary Examiner*—Gil Weidenfeld
*Assistant Examiner*—Fred A. Silverberg
*Attorney, Agent, or Firm*—Bernard A. Chiama

[57] ABSTRACT

A stapler having an improved anvil to which staples are applied during a driving operation by a driver member for the apparatus. The anvil includes two pivotal ears each of which is formed with a cutting edge which cooperates with a fixed cutting edge arranged to cut the excess portions of staple legs. The length of the portions being cut is in accordance with the number of sheets being stapled, the less the number of sheets, the longer length being cut.

1 Claim, 4 Drawing Figures

STAPLER APPARATUS HAVING A MECHANISM FOR BENDING AND CUTTING STAPLE LEGS IN ACCORDANCE WITH THE THICKNESS OF THE WORK PIECE

This invention relates to improvements in fastener applying apparatus for attaching sheets of paper. The present invention is particularly applicable to stapling devices, finishers and the like which are associated with copying machines having a finishing assembly which receives finished copy sheets in collated sets, are jogged and then stapled for use by an operator.

In conventional copy machines which employ staplers or finishing apparatus, problems have arisen when attempts are made to utilize the stapler for copy sets which range from a few sheets of paper up to sets which include 30 or more sheets. In commercial machines having stapling devices, use is made of various sizes of staples wherein staples with long legs are used for sets having a relatively large number of copy sheets, and short legged staples are utilized for the lower range of the number of copy sheets. In between these two extremes of the number of sheets there may be other sizes of staples utilized. In these situations, the operator must either remove all of the staples from one or more of the staplers associated with the copying machine and insert quantities of staples of the size more compatible to the number of sheets in the set for which he is preparing to produce. This entails removing perhaps thousands of staples from each of the stapling devices associated with the machine and reinserting great quantities of the desired staple.

The alternative to incorporating procedures and apparatus for effecting staple size changes is to neglect or refrain from making changes in staple sizes. In this situation, the machine utilizes a standard size staple, one having relatively long legs for the maximum number of sheets in a set the copy machine is adapted to collate. Generally, the combined length of both legs of the staple is greater than the length of the crown. When the copy machine is programmed then to produce sets containing 2, 3, 4, or 5 sheets and use is maintained for the long legged staples, the staples will repenetrate such set during a stapling operation and the legs will protrude outwardly from the top sheet of the set thus presenting a very unsightly stapled set. In addition, with the two relatively sharp tips of the staple protruding through the top sheet there is great likelihood the recipient of a set will puncture the skin of his fingers in handling the set. Furthermore, when a number of sets having this condition of said staples are piled one upon the other such as in a file folder, the corner of the set having the staples becomes rather bulky and more than likely may even damage the edges of other papers in the file.

The present invention avoids the above discussed disadvantages by utilizing an arrangement of cutting edges on the clinching devices for a stapling apparatus, thus being effective to cut excess material on the legs of a staple. The amount of material cut off is determined in accordance with the number of sheets of paper being stapled in order to shorten the portions of the legs driven through the sheets. The shortened portions are unable to repenetrate the sheets to the extent that there is no protrusion through the first sheet of set.

Therefore, the principal object of the present invention is to improve stapling capability of a stapler device in handling thin sets of sheets, say on the order of a few sheets, as well as thick sets, on the order of 30 or more sheets.

Another object of the invention is to improve the range of applicability of a stapling device without increasing its cost of manufacture or the necessity of providing sophisticated engineering techniques in developing an improvement to the device.

Further objects and advantages of the present invention are set forth or will appear from the following specification which describes a preferred form of the invention by way of example and is illustrated by the accompanying drawings wherein.

Figure 1:
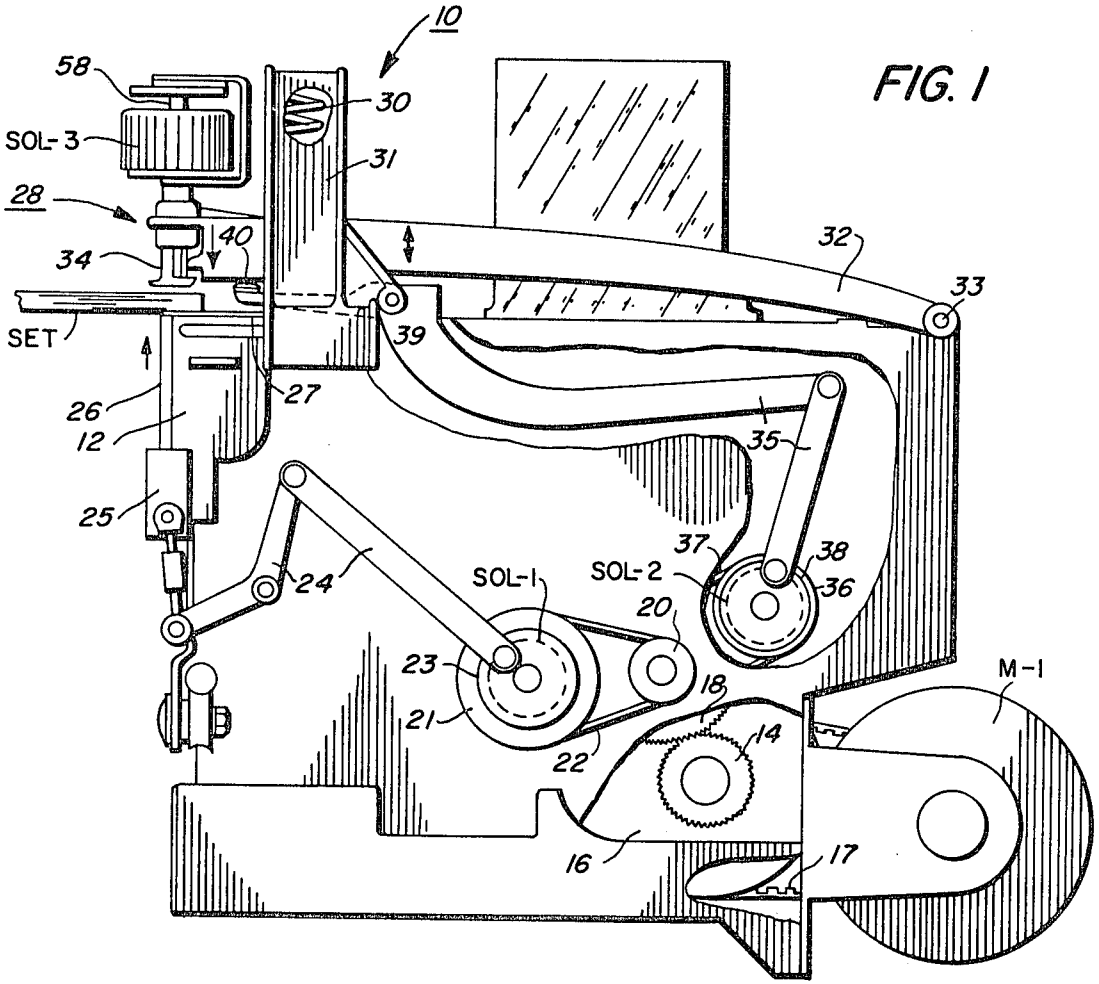
FIG. 1 is a side elevational view of a motor/solenoid operable stapling apparatus embodying the principles of the present invention.

In the specification and accompanying drawings, the stapler apparatus disclosed for which the present invention is embodied for illustration purposes only, is a motor/solenoid operated implement particularly adapted for use in a copying machine, and includes one or more stapler heads such as a commercial stapler sold in the market. For this combination, attention is directed to U.S. patent application Ser. No. 180,184, filed on Aug. 21, 1980. The stapling apparatus, generally indicated by the reference numeral 10, includes one or more stapling heads 12. It is to be understood that this utilization is only for exemplary purposes and that the stapling heads 12 utilized in the present invention may also assume other forms.

Stapling is achieved by way of one or two identical mechanisms, each of which provides the function of set clamping, staple driving, and staple clinching. Preferably, the stapler heads 12 are of the commercial type, such as the Bostitch staple head indicated at the 64-E manufactured by the Bostitch Division of Textron Corporation of Providence, Rhode Island. Since the stapler mechanisms, drives therefor, and related structure are identical, only one will be described in detail.

Each of the heads 12 is mounted in an inverted position and is driven from a crank mechanism through a motor M-1. The mechanism includes an elongated, splined drive shaft 14 which is driven by the motor M-1 by means of a pulley 16 and timing belt 17, the drive shaft effecting clamping sets or stacks of sheets and actuation of the heads for driving staples thereinto. The driving connection between each of the heads 12, relative to the shaft 14, includes a gear 18 in continuous driving engagement with a splined section on the shaft so that each head may be moved toward and away from each other, or in the same direction, thereby permitting desired positioning of staples on the edges of sets or stacks.

The gear 18 is connected to a pulley 20 by way of a common shaft for imparting rotary motion to a drive pulley 21 by means of a timing belt 22 connected therebetween. The drive pulley 21 intermittently rotates a rotary cam element 23 a full revolution upon energization of an electromagnetic clutch SOL-1 for imparting cranking action to a crank mechanism 24. This cranking motion imparts a cycle of corresponding reciprocable motion to a plunger 25 to which a staple driver 26 for the stapler head 12 is connected.

Prior to staple driving, the edge of a set of sheets to be stapled is clamped between the head 12 and a clinching mechanism generally indicated by the reference numeral 28 by a relatively heavy coil spring 30. The spring 30 has its upper end fixed against a brace 31 supported upon the frame for the finishing apparatus 10 and its lower end active against a point adjacent one end of a relatively long drive lever 32. The extreme outer end of the lever 32 supports the clinching mechanism 28 while its other end is pivotally retained at point 33 on the frame of the apparatus 10.

The clinching mechanism 28 includes a clamp plate 34 at its lower end and this clamp plate is adapted to engage the upper sheet of the set of sheets and to force the edge of the set against the head 26 under bias of the spring 30 prior to a stapling condition. Loading of the spring 30 and positioning of the clamp plate 34 in its uppermost position as shown in FIG. 1 is achieved by means of the motor M-1 in conjunction with a crank system 35 and an electromagnetic clutch SOL-2. The constantly driven gear 18 is drivingly connected to a pulley 36 by a suitable timing belt 37. A rotary cam element 38 rotatably mounted on a common shaft with the pulley 36 is connected to the crank system 35. The clutch SOL-2, when energized, is adapted to drivingly connect the pulley 36 to the plate 38 for one half revolution per energization to the position shown in FIG. 1. This driving action actuates the crank 35 about a pivot 39 and thereby upwardly drives a contact pad 40 secured to the outermost end of the crank 35 and in contact with a lower surface of the lever 32, against the bias of the spring 30. When the clutch SOL-2 is deenergized, the spring 30 is released and forces the clamp plate 34 against the compiled set of sheets just prior to a stapling action.

Figure 2:
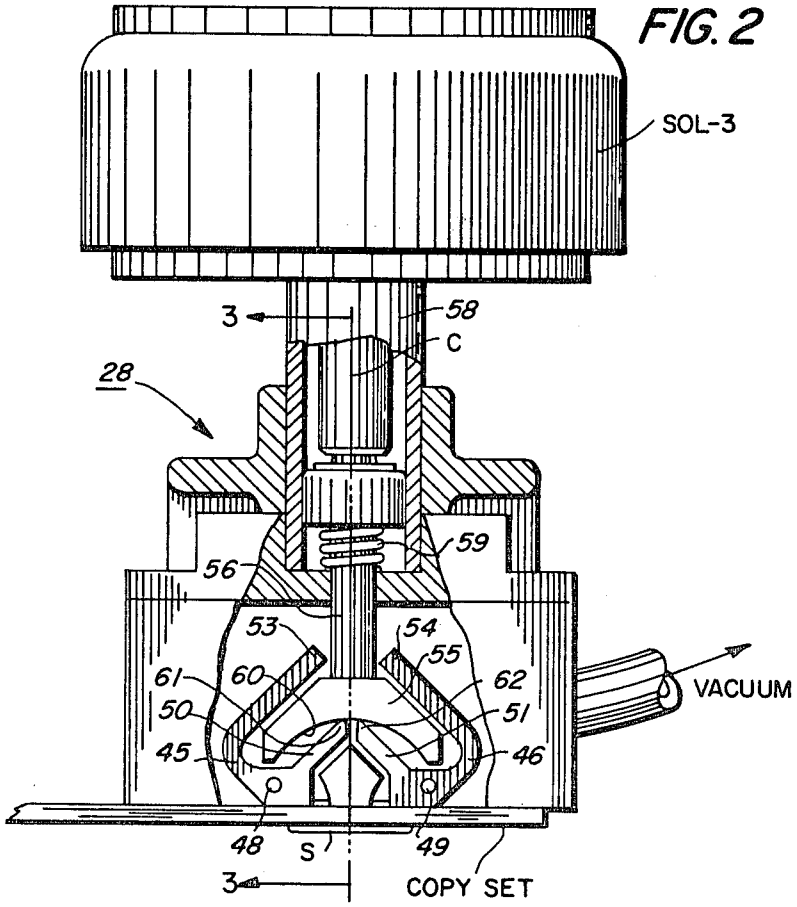
FIG. 2 is an exploded front view of some of the components of the stapling head member shown in FIG. 1.

As shown in FIG. 2, the clinching mechanism 28 is of the bypass active type and includes a pair of clinching ears 45, 46 of identical shape and symmetrically arranged relative to the vertical centerline C for the clinching mechanism. The clinching ear 45 is pivotally mounted at 48 while the ear 46 is pivotally mounted at 49. Each of the ears 45, 46 are formed with an anvil section 50, 51 respectively, which in turn are formed with clinching grooves on their lower surfaces (not shown). For illustrative purposes only, the legs of a staple S are shown in contact with one end of the each of the sections 50, 51. Normally, for this position of a staple, the ears 45, 46 would have been rotated to another position of operation as will be described hereinafter.

Each of the ears 45, 46 are also formed with angled extensions 53, 54 respectively, which are arranged vertically in a common plane relative to the anvils 50, 51. The clinching ears 45, 46 are pivotally actuated, in opposite directions, in a stapling operation by an element 55 mounted for vertical movement within the frame for the clinching mechanism 28. The element 55 is connected to the lower end of a plunger rod 56 which is driven vertically downward by the armature 58 for a clinching solenoid SOL-3 when the latter is energized. When the solenoid SOL-3 is deenergized, the armature 58 therefor is returned to its upward inactive portion by a coil spring 59. Similarly, the element 55 is also driven to its upper position, as shown in FIG. 4 by the spring 59.

Figure 3:
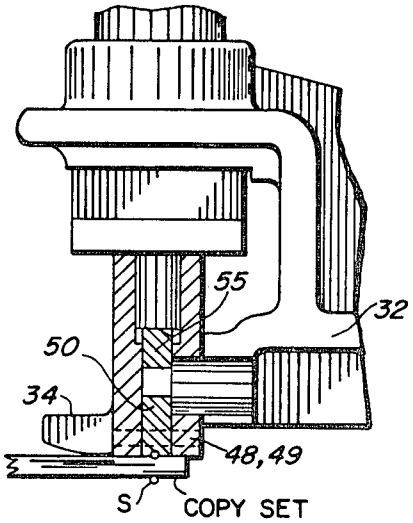
FIG. 3 is a detailed fragmentary cross sectional view of the stapling head taken along the line 3—3 in the position that it assumes in driving a staple.
Figure 4:
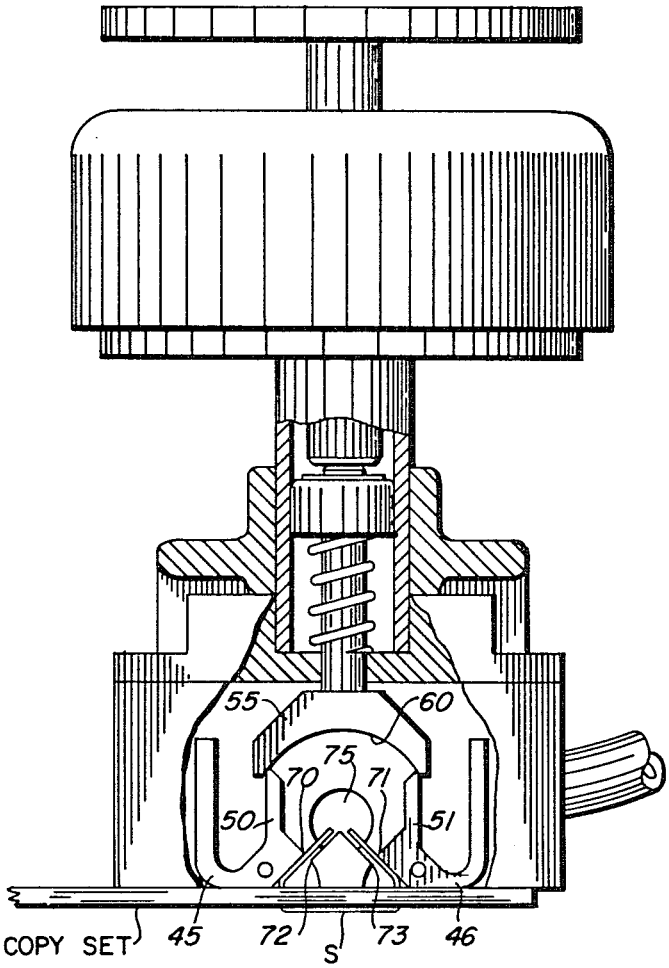
FIG. 4 is a partial front view similar to FIG. 2 showing parts in another position of operation of a detail.

Normally, before a staple is separated from its supply stick in the magazine for the stapler head 12 by the driver 26, the clinching ears 45, 46 are in the position shown in FIG. 4. In being moved to its uppermost position by the spring 59, the element 55 engages the extensions 53, 54 of the ears 45, 46 respectively, causing the resulting pivotal action of the ears in assuming their illustrated position in FIG. 4. When the solenoid SOL-3 is energized, the element 55 is activated to its lowermost position as shown in FIG. 3 and causes the pivotal action of the ears in assuming their respective positions. This action is achieved by the engagement of the curved undersurface 60 of the member 55 with cam lobes 61, 62 formed on the anvils 50, 51 respectively. As the surface 60 lowers and with the cam lobes 61, 62 in engagement with the outer ends of the surface 60, the lobes slide toward the centerline C thereby forcing the lower surface of the ears 45, 46 and the clinching grooves 52 formed therein to assume a generally horizontal plane.

As previously stated, the ears 45, 46 are in inoperative condition when in the respective positions as shown in FIG. 4. During a stapling operation, when the predetermined number of sheets in the set has been positioned between the clamp 33 and the head 12, the clutch SOL-2 is deenergized to effect release of the lever 32 and permit releasing of the spring 30 and lowering of the clamp plate 34 into clamping condition relative to the set of sheets. This lowering of the clamp 34 also carries with it the clinching mechanism 28 which is also mounted on the end of the clamping lever 32.

Within the same time frame when the set is being clamped, the clutch SOL-1 is energized to effect the upward drive of the driver 26 and the consequent separation of a staple from the staple stick containing the same. The staple is driven through the set of sheets and to the position with the tips of the legs entering the respective outer ends of the grooves 52. Further continuing movement of the legs causes the bending of the same as the tips of the leg slide along the grooves positioned at an angle relative to the horizon as shown in FIG. 4. When the staple has completed its movement by the driver 26, the solenoid SOL-3 is energized in order to rotate the ears 45, 46 from their positions shown in FIG. 4 to that shown in FIG. 3 thereby causing the bending of the legs of the staple as the lower surfaces of the ears are forced into a horizontal orientation. In this manner, the stapling operation is completed: the solenoid SOL-3 is deenergized to release the ears, the clutch SOL-1 energized to produce a one-half revolution of the element 23 to return the driver 26 to its inoperative position, and clutch SOL-2 is energized to cause raising of the lever 32, release of the clamp 34 and loading of the spring 30, all ready and disposed for another stapling operation. The above recited sequence for the energization of the various solenoid may not be in the order in which enumerated. It will be understood that because of structural inertia, tolerances and content of moving parts, the timing and/or sequence of energization of the clutches and solenoid may have to be adjusted so that the resultant final action is in proper sequence, that is, for clamping, staple driving and clinching.

Since the disclosed apparatus is arranged to utilize a single size of staple, it will be apparent that the same size staple must be available to bind sets of sheets which range anywhere from two sheets to 40 or more. If a staple size is chosen having legs long enough for 40 or more sheets, stapling sets containing 2, 3, 4 or 5 sheets presents a problem relative to the excess in length of the legs after the clinching operation. Having legs with excessive lengths during a bending action may result in repenetration or one leg interferring with the other and producing undesired skewing thereof with possible misforming. There is also the likelihood of jamming of a staple in the stapler head, and certainly an unsightly finished attaching staple.

In the present invention, each of the clinching ears 45, 46 is provided with a cutting edge which cooperates with a mating cutting edge formed on the frame for the clinching mechanism 28. The coacting cutting edges serve to cut the legs of a staple which protrude beyond a limit as determined by the number of sheets in a set being stapled as will be discussed below.

The lower surface of the portion 50 for the clinching ear 45 is formed with a cutting edge 70 while the ear 46 is similarly formed with a cutting edge 71 along the lower surface of the portion 51. Each of the cutting edges 70, 71 mate with a cutting edge 72, 73, respectively, formed on the frame structure for the clinching mechanism 28 and through which the centerline C extends.

During a stapling operation, a staple S is driven through the set of sheets and the legs of the staple contact the portions 50, 51 at the grooves 52 formed therein. With the clinching ears 45, 46 in their respective position shown in FIG. 4, as the staple is driven, legs commence bending inwardly due to the inclined angles in which the grooves 52 are positioned. Each of the legs of the staple follow the grooves 52 eventually projecting beyond the respective mated cutting devices 70, 72 and 71, 73. The length of the legs which extend beyond those cutting devices is determined by the number of sheets in a set being stapled. If many sheets are in a set, say on the order of 40 or more, the legs of a staple may not reach the mating cutting devices because most of their length is absorbed in the sheets. On the other hand, for the same size staple, and with only 2, 3, 4 or 5 sheets being stapled, a relatively large section of the legs will extend beyond the cutting devices. In stapling sets comprising six to 40 sheets, the length of the legs to be cut will vary according to the number of sheets. A vacuum nozzle 75 is shown adjacent the cutting devices 70, 72 and 71, 73 and is connected to a suitable source of reduced air pressure to draw away the cut legs of staples.

From the foregoing it will be appreciated that the present invention allows the use of a single size staple in a stapler head for stapling sets comprising two sheets to over 40 sheets while at the same time avoiding leg repenetration, mis-shapen legs, the presence of undesirable excess staple material and possible jamming of staples in the head.

While the invention has been described with reference to the structure disclosed, it is not confined to the details set forth but is intended to cover such modifications or changes as may come within the scope of the following claims.

I claim:

1. In a stapler apparatus having a staple dispensing means being adapted to cooperate with an anvil mechanism to permit individual ones of staples to be dispensed toward and against the anvil mechanism to perform a stapling operation; and wherein the anvil mechanism includes two movable clinching members for bending legs of a staple after being driven through sheets to be stapled; and a power device for actuating the clinching members; the improvement including:

a member mounted adjacent the anvil mechanism and having a pair of cutting edges thereon, each of the clinching members being formed with a cutting edge cooperable with one of said cutting edges respectively, during bending of the legs, and a drive means connected to the clinching members for actuating the same to bend the legs of the staple thereby effecting cutting of the legs during clinching thereof.

* * * * *